US007669838B2

(12) United States Patent
North

(10) Patent No.: US 7,669,838 B2
(45) Date of Patent: Mar. 2, 2010

(54) AIR HANDLING HEAT EXCHANGER HUMIDIFYING APPARATUS

(75) Inventor: Gary Martin North, Karalee (AU)

(73) Assignee: Co-Ordinated Thermal Systems Pty Ltd, Queensland (AU)

( * ) Notice: Subject to any disclaimer, the term of this patent is extended or adjusted under 35 U.S.C. 154(b) by 760 days.

(21) Appl. No.: 11/335,631

(22) Filed: Jan. 20, 2006

(65) Prior Publication Data

US 2006/0163756 A1 Jul. 27, 2006

Related U.S. Application Data

(60) Provisional application No. 60/645,051, filed on Jan. 21, 2005.

(51) Int. Cl.
*B01F 3/04* (2006.01)

(52) U.S. Cl. ..... 261/140.1; 261/112.2; 261/113

(58) Field of Classification Search ..... 261/110, 261/111, 112.1, 112.2, 113, 140.1
See application file for complete search history.

(56) References Cited

U.S. PATENT DOCUMENTS 997,430 A * 7/1911 Whittlesey ..... 261/29
1,633,289 A * 6/1927 Robinson ..... 261/98
2,241,674 A * 5/1941 Mohr, Jr. et al. ..... 261/158
2,777,677 A * 1/1957 Bunch ..... 261/158
2,930,208 A * 3/1960 Lyman ..... 62/428
3,512,763 A * 5/1970 Winton ..... 261/141
3,784,171 A * 1/1974 Engalitcheff et al. ..... 261/29
4,044,078 A * 8/1977 Curtis et al. ..... 261/30
4,105,724 A * 8/1978 Talbot ..... 261/112.1
4,562,015 A * 12/1985 Lefevre ..... 261/94
4,915,877 A * 4/1990 Shepherd ..... 261/111
5,946,931 A 9/1999 Lomax et al.
2005/0051916 A1 * 3/2005 Kinder et al. ..... 261/112.2

FOREIGN PATENT DOCUMENTS

EP 0 632 240 A1 1/1995

* cited by examiner

*Primary Examiner*—Scott Bushey
(74) *Attorney, Agent, or Firm*—Birch, Stewart, Kolasch & Birch, LLP

(57) ABSTRACT

An air handling heat exchanger humidifying apparatus (1) is provided with a humidifying cell (13) of a self supporting sheet like body with closely spaced air openings therein. Air is moved through the apparatus (1) so it passes through the openings in the humidifying cell (13). A humidifying liquid is deposited onto the body surfaces of the cell between adjacent openings. As the air moves through the openings it collects the humidifying liquid from the surfaces of the cell (13). The humidifying liquid can be cooled. The air then exits the apparatus (1) and can be used for cooling produce or other product. The cell (13) can be an expanded mesh with the openings having a somewhat diamond shape. The cell (13) body can be corrugated to assist in humidifying liquid retention.

9 Claims, 10 Drawing Sheets

AIR HANDLING HEAT EXCHANGER HUMIDIFYING APPARATUS

This application is based on and claims the benefit of the filing date of U.S. application Ser. No. 60/645051 filed 21 Jan. 2005 the contents of which are incorporated herein by reference in its entirety.

FIELD OF THE INVENTION

This invention relates to air handling heat exchanger apparatus which has particular although not exclusive application in fresh produce store rooms where the produce is to be maintained in a cool and high humidity environment.

BACKGROUND ART

Hitherto, air handling heat exchanger humidifying apparatus has been known. One typical example is disclosed in Australian patent 563636. The disclosure in that document is hereby incorporated by reference. In apparatus disclosed in the above patent, there is a heat exchanger cell formed from strands or filaments and the cell has a substantial depth in the direction of air flow therethrough. The cell itself occupies a considerable volume within the air handling heat exchanger humidifying apparatus. This has resulted in the apparatus itself being quite large and because of this size, it is generally not feasible to mount the air handling apparatus to a ceiling of a conventional cool room used for storing fresh produce because its size limits the volume of the produce that can then be stored therein.

In the heat exchanger cell of the aforementioned type, the construction of the cell is quite labour intensive. Further, the fitting of the cell within the air handling heat exchanger apparatus has been difficult owing to the bulk of the cell itself.

OBJECTS & STATEMENT OF THE INVENTION

There is a need for an improved air handling heat exchanger humidifying apparatus and for an improved air handling heat exchanger humidifying cell therefor. Certain examples of the present invention enable a compact size for an air handling heat exchanger humidifying apparatus to be provided by the utilisation of, in one example, a compact air handling heat exchanger humidifying cell. This, in turn, permits a compact height apparatus which can be readily installed in existing cool rooms without unduly inhibiting the volume of the produce to be stored therein.

In one aspect of the present invention there is provided an air handling heat exchanger humidifying cell, said cell comprising a self supporting generally sheet like body, said body having a multitude of air openings therethrough and defining with said air openings surfaces on which a humidifying liquid can be deposited, said cell being mountable, in use, so said generally sheet like body is disposed in a generally horizontal extending self supported plane, and whereby humidifying liquid can be deposited onto the upper surfaces of the body from above the cell, and where air can be passed through the air openings to collect deposited humidifying liquid from said surfaces.

Most preferably the cell is of a mesh like sheet configuration with closely spaced air openings and wherein the material of the body between adjacent air openings provides arm surfaces onto which the humidifying liquid can be deposited.

Most preferably the mesh is an expanded mesh.

Most preferably the mesh openings are generally diamond shaped.

Most preferably the body is an expanded mesh and the arm surfaces are flattened surfaces formed by a flattening process after a mesh expansion process.

Most preferably the sheet like body is corrugated to assist in humidifying liquid retention thereto so retained humidifying liquid will be available for collection by the air that passes through the openings.

Most preferably there are many corrugations that are of a regular saw tooth profile across the cell, and wherein all the corrugators are of the same size and shape.

Most preferably the cell is made from metal.

Most preferably the cell is made from titanium.

In a further aspect of the preset invention there is provided an air handling heat exchanging humidifying apparatus comprising;

a heat exchanger humidifying cell, said cell having a self supporting sheet like body with a multitude of air openings therethrough, the body and the openings defining surfaces on which a humidifying liquid can be deposited, cell mounting means mounting said cell so the body is in a generally horizontally extending self supporting plane, humidifying liquid distribution means above said cell for distributing humidifying liquid so it will be deposited onto the top of the cell, an air mover for moving air through the openings of the cell where humidifying liquid on said surfaces can be collected by the passage of air, and an air outlet for permitting discharge of air and any collected humidifying liquid external of apparatus.

Most preferably the apparatus includes a humidifying liquid cooler for cooling the humidifying liquid that is deposited onto the surfaces of said cell.

Most preferably the cooler has a heat exchanger situated between the humidifying liquid distributing means and an upper surface of said cell so that as humidifying liquid is distributed, said humidifying liquid passes through said heat exchanger and is cooled thereby before being collected on said surfaces.

Most preferably the cell is of a mesh like sheet configuration with closely spaced air openings and wherein the material of the body between adjacent openings provides arm surfaces onto which the humidifying liquid can be deposited.

Most preferably the mesh is an expanded mesh.

Most preferably the mesh openings are generally diamond shaped.

Most preferably the cell is of an expanded mesh sheet like configuration and the arm surfaces are flattened surfaces formed by a flattening process after a mesh expansion process.

Most preferably the sheet like body is corrugated to assist retention of humidifying liquid and the subsequent collection of the humidifying liquid by air that passes through said openings.

Most preferably there are many corrugations and the profile of each of the corrugations is of a regular saw tooth configuration.

Most preferably the cell is made of metal.

Most preferably the cell is made from titanium.

In a further aspect of the present invention there is provided a method of making a self supporting cell for an air handling heat exchanger humidifying apparatus from a sheet of metal of sufficient thickness and rigidity to be self supporting comprising;

slitting the sheet at a multitude of spaced intervals, subsequently expanding the sheet so that each slit forms a generally diamond shaped opening through the sheet, and providing the expanded sheet for insertion into an air handling heat exchanger humidifying apparatus.

Most preferably the openings are closely spaced and wherein the metal between adjacent openings defines arm surfaces on which humidifying liquid can be deposited during operation of the apparatus.

Most preferably the sheet is flattened after expansion so the arm surfaces are generally co-planar with the sheet.

Most preferably the sheet is corrugated after expansion and flattening.

Most preferably there are many corrugations and the profile of each of the corrugations is of a regular saw tooth configuration.

Most preferably the cell is made of titanium.

In a further aspect of the present invention there is provided a method of humidifying air in an air handling heat exchanger apparatus comprising;

providing a cell in said apparatus, said cell being self supporting and having a generally sheet like body with a multitude of air openings therethrough and having body surfaces between adjacent openings on which a humidifying liquid can be deposited, said cell being oriented within said apparatus so said sheet extends in a generally horizontal plane, depositing humidifying liquid on said body surfaces, and, causing air to be passed through said openings to collect humidifying liquid from said surfaces and to be subsequently discharged from said apparatus.

Most preferably said air is passed upwardly through said openings and said humidifying liquid is deposited onto said surfaces by being discharged within said apparatus from a height above said cell.

BRIEF DESCRIPTION OF THE DRAWINGS

In order that the invention can be more clearly ascertained, examples of embodiments will now be described with reference to the accompanying drawings wherein.

DETAILED DESCRIPTION OF EXAMPLES

Figure 1:
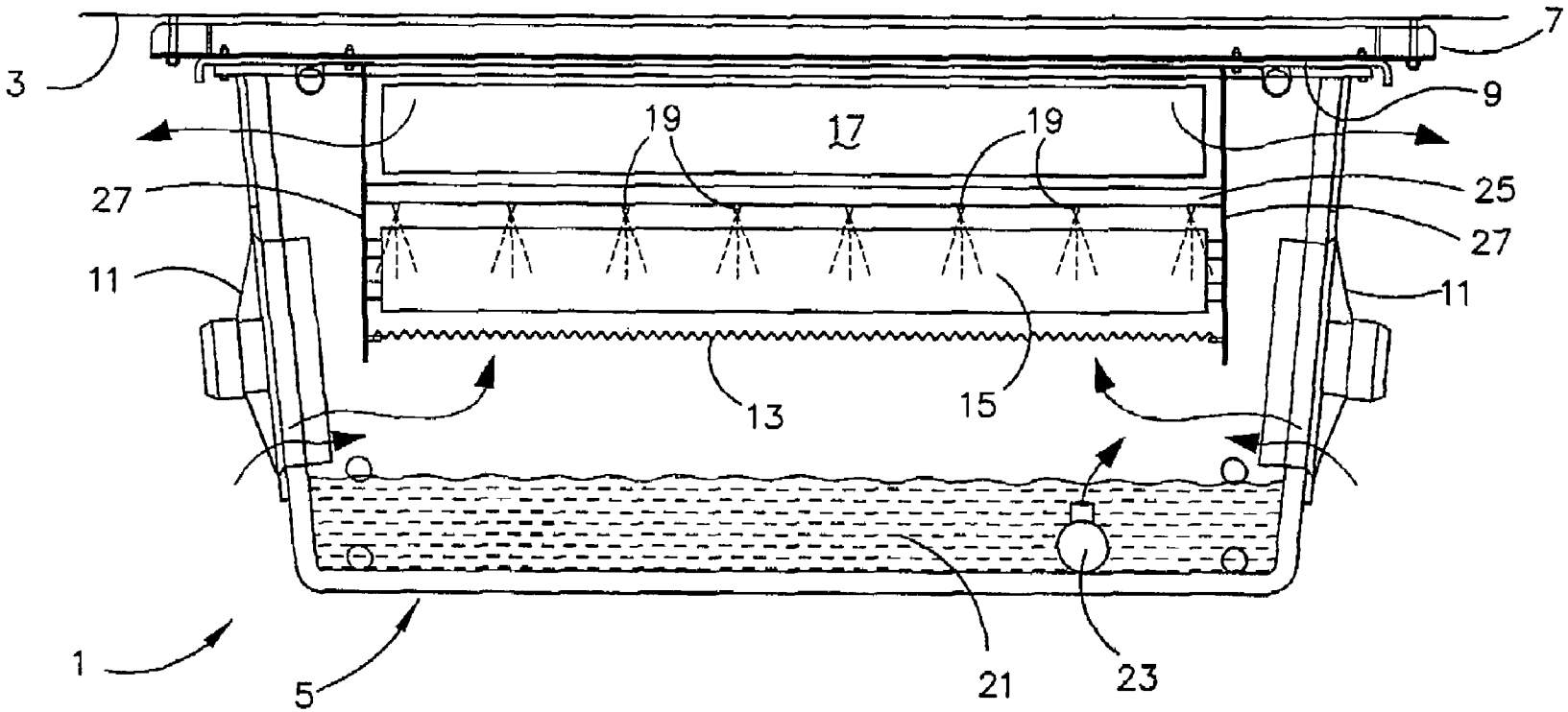
FIG. 1 is an end cross sectional view of one example of an air handling heat exchanger humidifying apparatus incorporating one particular example of an air handling heat exchanger humidifying cell.

Referring to FIG. 1, it can be seen that an air handling heat exchanger humidifying apparatus 1 is mounted suspended to a ceiling 3. In other examples, the apparatus may be placed on the floor or mounted on a wall. Ceiling mounting is not an essential part of the inventive concept. The apparatus 1 has an outer case 5 of generally rectangular configuration and box-like. Typical, although not limiting, dimensions are 2 meters wide, 1 meter deep and 0.8 meter high. The case 5 has a lid 7, and a chassis 9 that supports the various components of the apparatus 1. The case 5 and the lid 7 are typically made from a fibreglass or like plastics material. The case 5 and the lid 7 however, may be made from other suitable materials such as wood that may be gel coated, or from metal. In this example, the case 5 and the lid 7 are made from fibreglass. The case 5 is internally thermally insulated with a suitable insulating foam material.

The case 5 has two inlet fans 11 that blow air into the apparatus 1 and cause the air to pass through an air handling heat exchanger humidifying cell 13 and through a liquid cooler heat exchanger 15 and out through an outlet 17. The outlet 17 is on a side wall of the case 5. This is not clearly shown in FIG. 1 but is better shown in FIG. 9. Mounted above the liquid cooler heat exchanger 15 are humidifying liquid distribution means 19 in the form of spray nozzles. The spray nozzles spray the humidifying liquid, (typically water) from a height above the cell 13 so that the humidifying liquid is distributed substantially evenly to pass through the liquid cooler heat exchanger 15 where the humidifying liquid is cooled. The cooled humidifying liquid is then distributed substantially evenly to surfaces of the cell 15. The cell 15 has a multitude of air openings therethrough (as will be described hereinafter) and thus air that is forced into the apparatus 1 by the fans 11 is caused to pass through the cell 13, through the openings therein, and to collect humidifying liquid from the surfaces of the cell 13, and to carry that collected humidifying liquid upwardly through the liquid cooler heat exchanger 15 and then out of the apparatus 1, through the outlet 17.

The case 5 provides a sump 21 in which the humidifying liquid can be stored as a reservoir of humidifying liquid. Suitable control valve means (not shown) is provided to allow replenishment of the humidifying liquid during operation of the apparatus 1. This may typically comprise a float valve means operatively connected with a mains water supply. A pump 23 is mounted within the apparatus 1 to pump humidifying liquid from the sump 21 to a header distribution tank 25, from where it can pass through the nozzles of the humidifying liquid distribution means 19. The sump 21 catches overflow humidifying liquid that passes through the cell 13.

Cell mounting means 27 supports the cell 13, the liquid cooler heat exchanger 15, and the header distribution tank 25, and ensures that the air that is moved into the apparatus 1 passes through the cell 13 before it is discharged from the outlet 17. The cell mounting means 27 is supported by the chassis 9.

FIG. 1 shows that the cell 13 is generally self supporting and is positioned within the apparatus 1 so that it extends in a generally horizontal plane.

Figure 2:
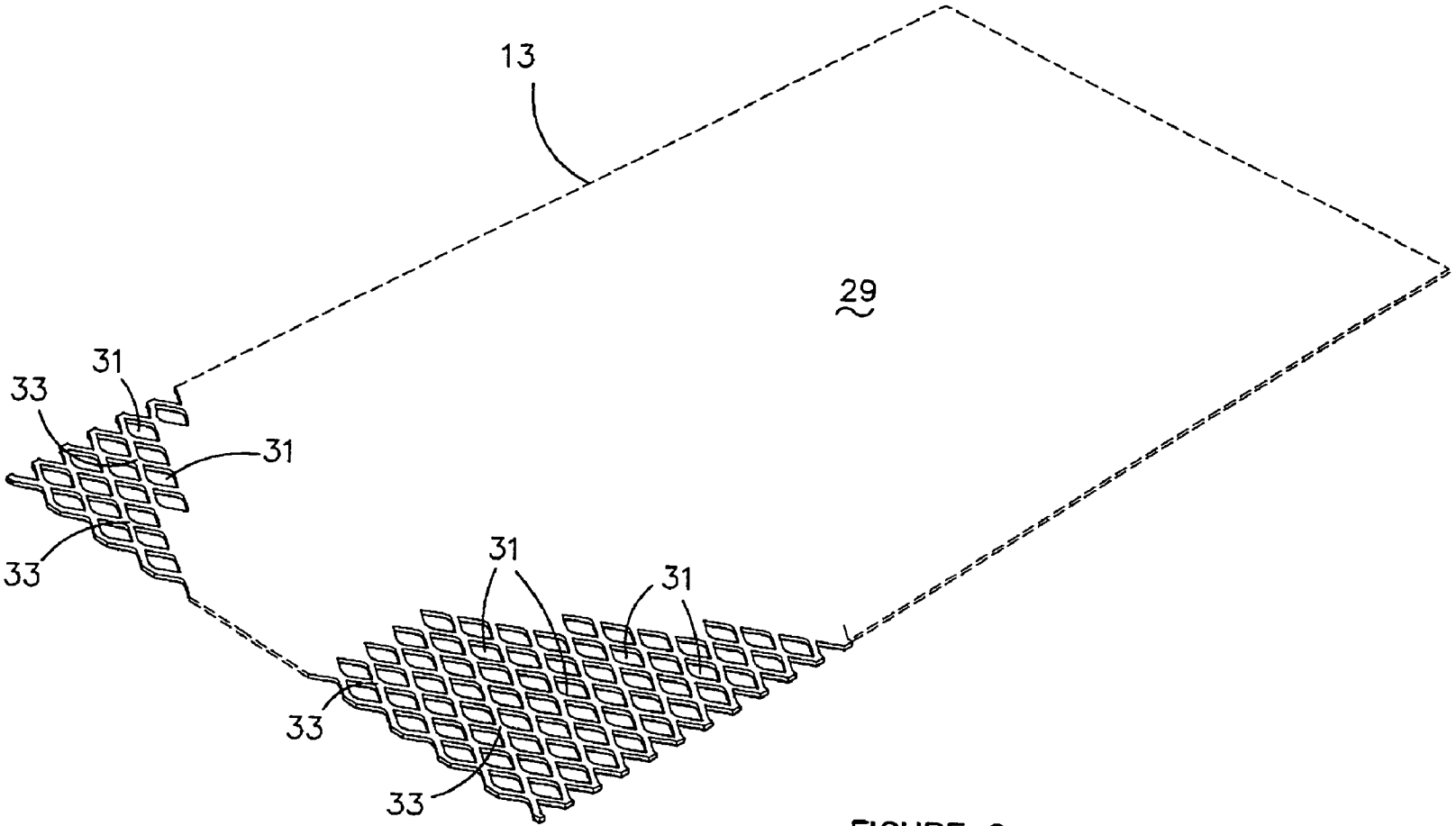
FIG. 2 is a top perspective view of the cell shown in FIG. 1.

Referring now to FIG. 2, which shows one type of cell 13, it can be seen that the cell 13 has a generally sheet like body with a multitude of air openings 31 therein. FIG. 2 is diagrammatic in that the openings 31 extend over the whole of the surface of the sheet like body 29. All of the openings 31 have not been shown in order to aid clarity in the drawing. The openings 31 are closely spaced and provide a mesh like arrangement to the cell 13. In the example shown, the cell 13 is made from a sheet of metal or other suitable materials such as plastics. Typically, the cell 13 is made from titanium because of the enduring properties of titanium. The cell 13 therefore has body material 29 between the adjacent air openings which provide arm surfaces onto which humidifying liquid can be deposited. These arm surfaces have been shown generally by reference numeral 33. In the example shown, the sheet like body 29 is expanded mesh and the openings 31 are generally diamond shaped as shown. The sheet like body 29 is therefore self supporting. Typical dimensions of the sheet like body 29 are approximately 1.0 m×2.0 m×1 mm so the cell can be retained within case 5. The length of each side of the diamond shaped openings 31 is typically 5 mm and the openings, whilst being diamond shaped, are square in shape. The width of the arm surfaces between adjacent openings 31 is typically 2 mm. In an alternative arrangement, the openings 3, may be simple openings formed in the sheet, and the cell need not be produced from expanded mesh.

Ideally, the size of the openings is chosen to be proportional to the size of a water droplet that will be distributed onto the arm surfaces 33. In this way, as a droplet falls downwardly within the apparatus, it will strike all four corners of an opening 31 and will deposit a proportion of the droplet to all the arm surfaces surrounding each opening 31. In this way, if all four corners of a diamond shaped opening 31 are hit by a water droplet, there will be the possibility of maximum water retention across each of the arm surfaces 33, and this will allow for the highest mass heat transfer possible to the air that passes through the openings 31.

Whilst the cell 13 has been described as being sheet like, and made from sheet material, it may be made from other suitable material so that it has a sheet like appearance. For example, the cell 13 may be fabricated from a mesh arrangement of rods or wires or lines that are suitably welded to one another by a known welding process. In this way, the openings 31 may be produced in the cell 13 and the rods or wires or lines will form the arm surfaces 33 between the openings 31. Such an arrangement is to be considered within the scope of the invention. Further, the shape of the openings need not be diamond shape. Again such an arrangement is to be considered within the scope of the invention.

Typically, the nozzles of the header distribution tank 25 are anti-clog jet nozzles which give a positive distribution of humidifying liquid with a known volume liquid flow rate. In the example shown, the nozzles are arranged to discharge the humidifying liquid in a conical spray in a downward direction. When the spray reaches the upper surface of the cell 13 there will be substantially uniform distribution of water droplets across the upper surface of the cell 13. In this way, the humidifying liquid will be cooled by the liquid cooler heat exchanger 15 and pass downwardly through the liquid cooler heat exchanger 15 and onto the upper surface of the cell 13. Some of the humidifying liquid will pass through the openings but some will remain on the arm surfaces 33. Thus, as the air passes through the openings 31 it will collect humidifying liquid from the arm surfaces 31, and that liquid will be entrained in the air flow. There will be consequential heat exchange to the air that passes through the cell 13. There will then be further cooling of the air as it passes upwardly through the liquid cooler heat exchanger 15.

Typically, the header distribution tank 25 is charged with a positive pressure to ensure there is a required humidifying liquid flow rate. The head pressure may be typically 20 psi. Typically, the fans 11 provide positive air pressure such that there is an air velocity from the outlet 17 of 8,500 liters/second. The pump 23 capacity is typically a 1.5 kw pump that will deliver a flow rate to each of the nozzles in the header distribution tank 25 of 0.15 liters/second. Typically, there are 40 nozzles distributed uniformly across the header distribution tank 25 so there will be uniform discharge of the humidifying liquid through the liquid cooler heat exchange 15 and onto the upper surface of the cell 13.

Figure 3:
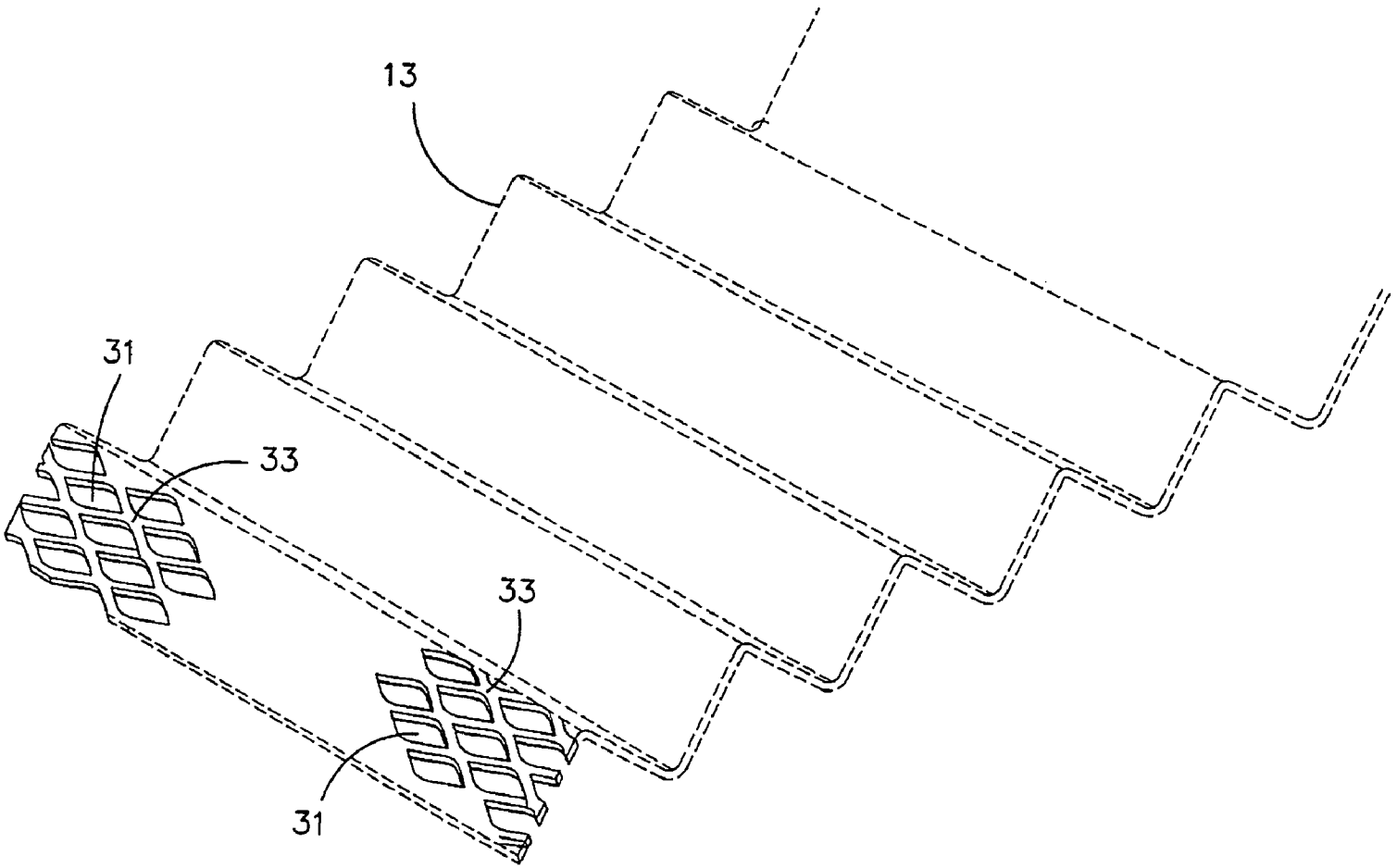
FIG. 3 is a view similar to that of FIG. 2, showing another example of a cell.

Referring now to FIG. 3, there is shown an alternative arrangement of cell 13. Here, it can be seen that the cell 13 is made in the same way as the cell 13 shown in FIG. 2. In FIG. 3 however, the cell 13 is corrugated. Typically, the corrugations are all of the same size and shape and are regular saw tooth profile corrugations. Typically, the corrugations are right angle corrugations. i.e. the angle between the inclined sides is 90°. It has been found that by corrugating the cell 13 there can be greater humidifying liquid retention on the arm surfaces 33. Thus, this, in turn, assists in the uptake and collection of the humidifying liquid with the air that passes through the openings 31 in the cell 13. Again, the cell 13 may be manufactured by wires or rod mesh, or by a plastics moulding technique.

Figure 4:
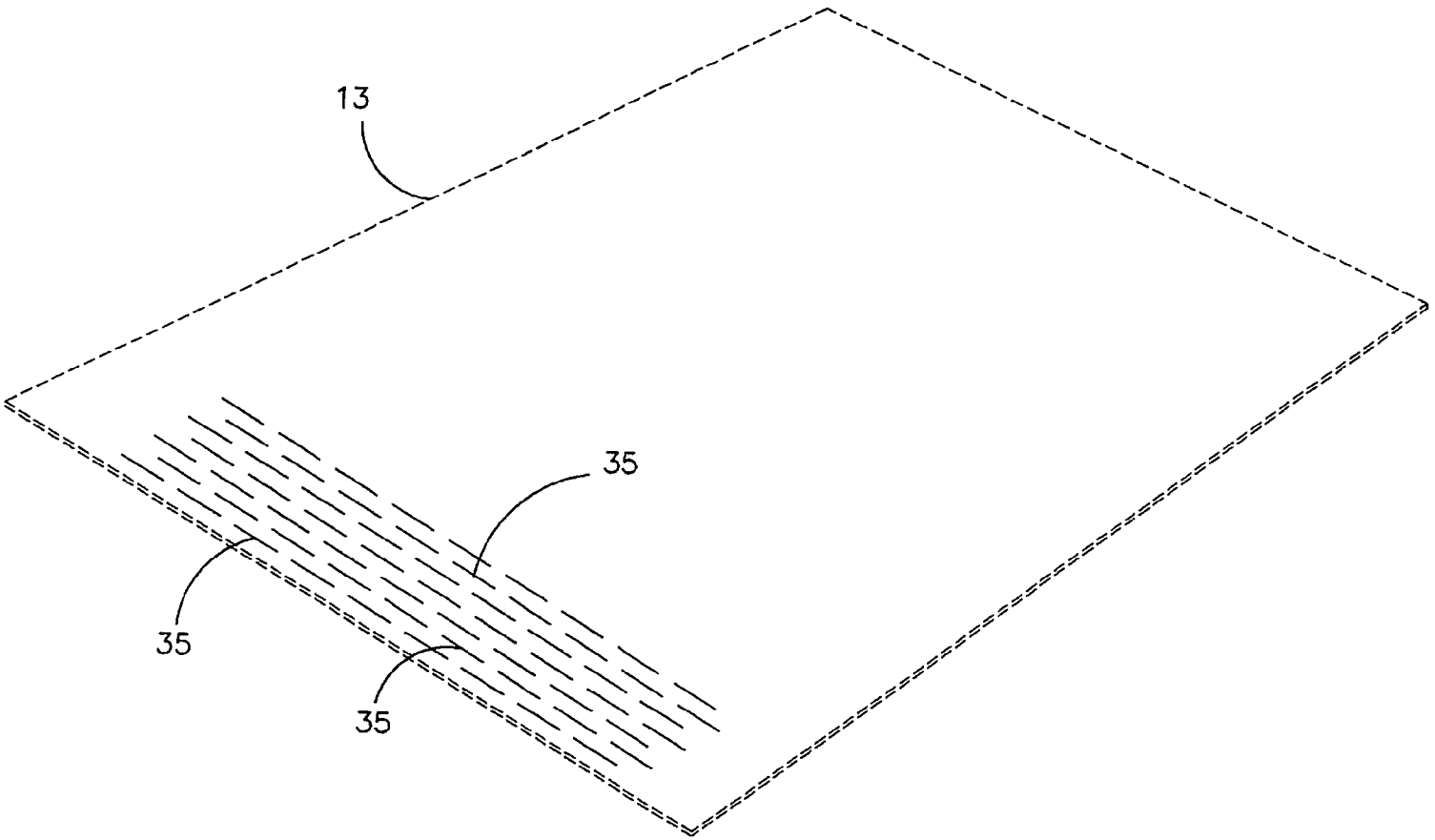
FIG. 4 is a diagrammatic top perspective view of a sheet of material showing how it is slitted for subsequent expansion to form the cell of FIG. 2 or FIG. 3.
Figure 5:
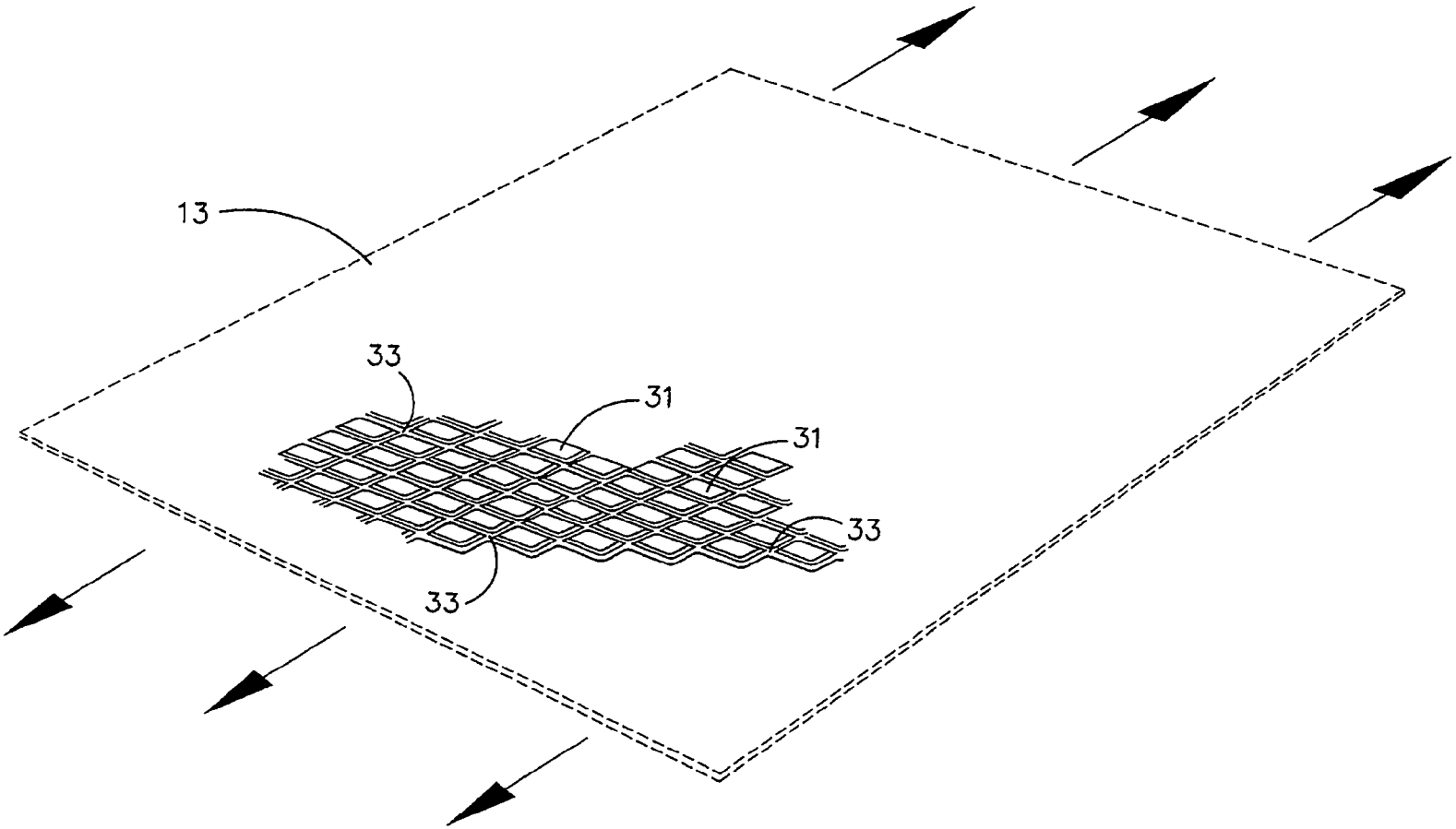
FIG. 5 is a view similar to FIG. 4 showing how the sheet material is expanded to provide openings in the cell.
Figure 6:
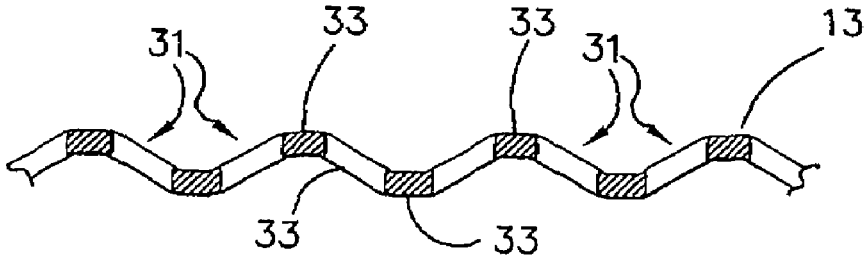
FIG. 6 is a cross sectional view of the expanded cell shown in FIG. 5, taken as a vertical cross section along section line 6-6 of FIG. 5.
Figure 7:
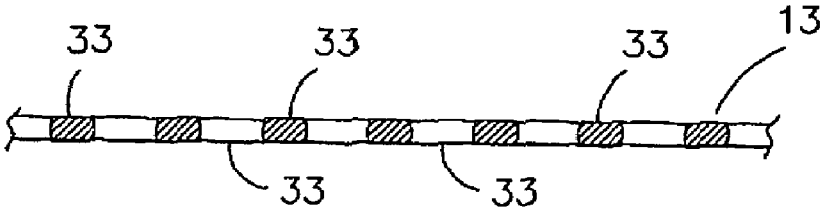
FIG. 7 is a view similar to that of FIG. 6 showing how the cell is flattened after expansion.

FIG. 3 shows an example of how a sheet body used for the cell 13 may be formed into a mesh sheet. Here, the cell body is typically a sheet of metal such as Titanium of 1.00 mm thickness. The sheet is then slit to produce a multitude of slits 35 in a grid. Only some of the slits 35 have been shown in order to aid clarity. The sheet is then pulled outwardly as shown in FIG. 5 to produce an open mesh sheet with a multitude of air openings 31. Only some of the openings 31 have been shown in FIG. 5 to aid clarity. The technique of producing a mesh as explained in relation to FIGS. 4 and 5 is known technology. That technology however, has not previously been applied to production of a cell 13. The cell produced by the method of FIGS. 4 and 5 can then be utilised within the apparatus 1 if desired. The arrangement is shown in cross section in FIG. 6. Here it can be seen that the openings 31 are generally in a plane inclined upwardly, whereas the arm surfaces 33 are generally horizontally extending. It has been found beneficial to flatten the expanded mesh as shown in FIG. 7. Here, the arm surfaces 33 are generally flattened to be generally coplanar with the sheet. This is to be constrasted to the example shown in FIG. 6 where there is lateral displacement upwardly and downwardly of parts of the arm surfaces 33. The arrangement shown in FIG. 7, with the flattening has been found to assist water retention on the arm surfaces 33 of the cell.

Figure 8:
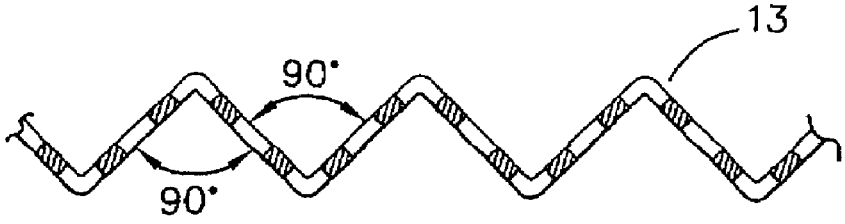
FIG. 8 is a longitudinal vertical cross sectional view, taken along section line 8-8 of FIG. 3, after the corrugating process.

FIG. 8 shows a further modification of the cell 13 to further enhance water retention on the arm surfaces 33 to, in turn, allow for greater take up of humidifying liquid in to the air that passes through the openings 31 and also greater mass heat transfer. In FIG. 8, the sheet like cell 13 has been corrugated as described with reference to FIG. 3. It can be seen that the corrugations are regular saw-tooth corrugations and that the angle between opposed faces is generally about 90°.

Figure 9:
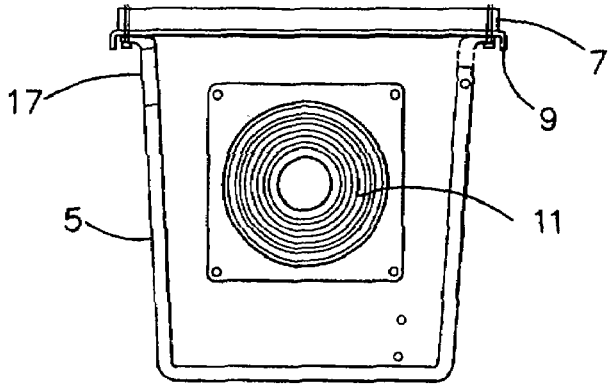
FIG. 9 is an end view of the apparatus shown in FIG. 1.

FIG. 9 is an end elevation of the apparatus shown in FIG. 1. FIG. 9 clearly shows the position of the outlet 17 in the base 5. A suitable plenum (not shown) enables the air to pass out from within the cell mounting means 27 to the outlet 17.

Figure 10:
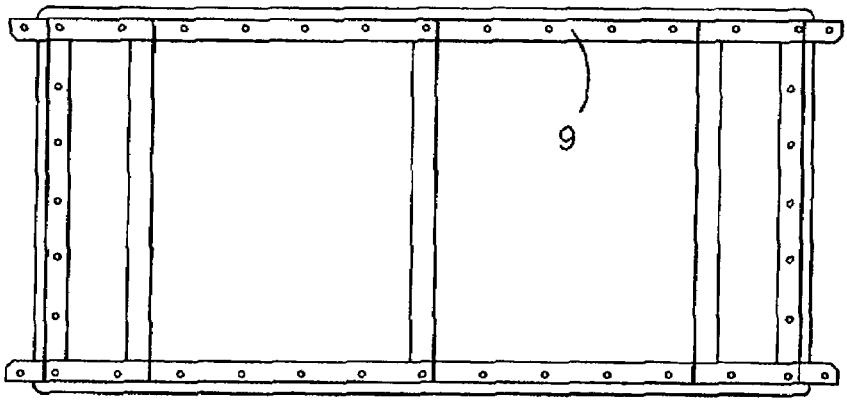
FIG. 10 is a plan view of a chassis of the apparatus shown in FIG. 1.

FIG. 10 is plan view of a chassis which supports the cell mounting means 27 and the various components within the case 5, as described previously. Here it can be seen that the chassis 9 is fabricated from angle metal and has a plurality of threaded holes 37 therein through which bolts can pass to sandwich the chassis 9 between the lid 7 and the case 5. Thus, when the apparatus 1 is suspended from a ceiling the chassis 9 supports the case 5 and the components that are within the case 5.

Figure 11:
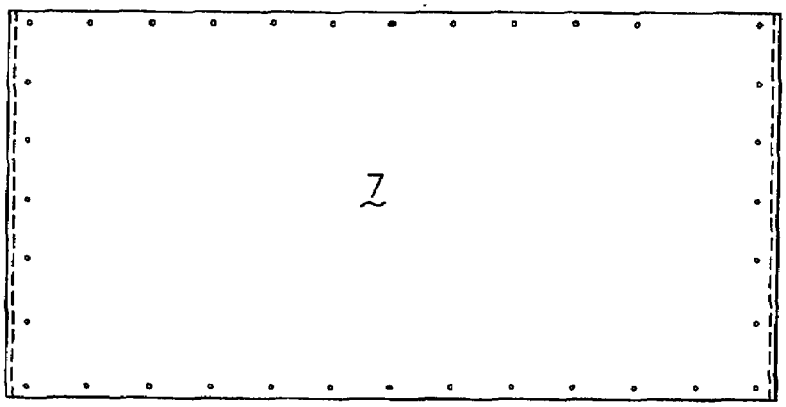
FIG. 11 is a plan view of a top of a casing of the apparatus shown in FIG. 1.
Figure 12:
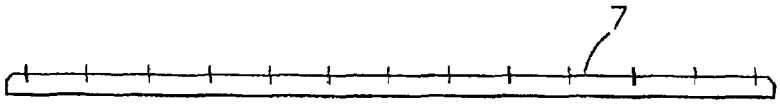
FIG. 12 is a side elevational view of the top shown in FIG. 11.

FIGS. 11 and 12 are plan views and side elevational views respectively, of the lid 7.

Figure 13:
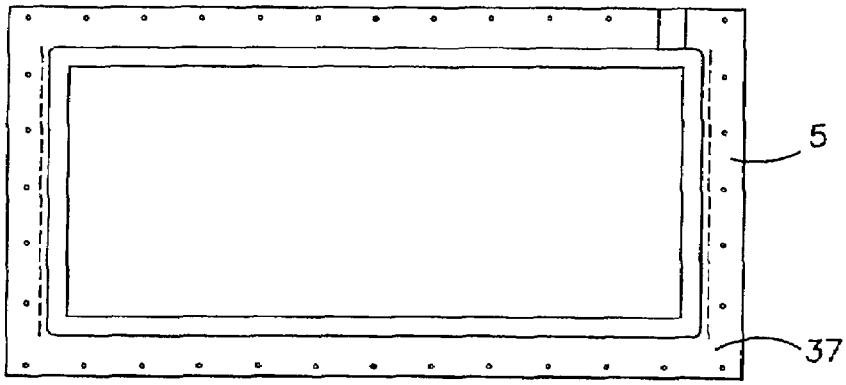
FIG. 13 is a plan view of a body part of the apparatus shown in FIG. 1.
Figure 14:
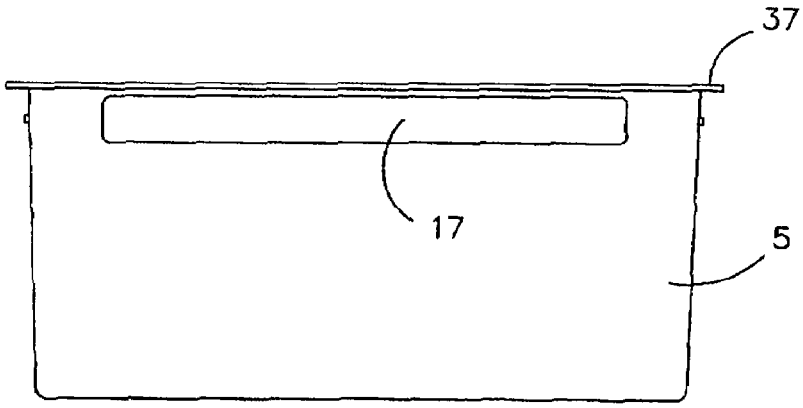
FIG. 14 is a front elevational view of the body shown in FIG. 13.
Figure 15:
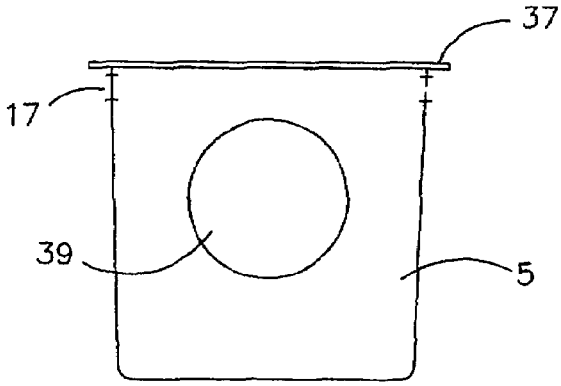
FIG. 15 is an end elevation of the body shown in FIG. 13.
Figure 16:
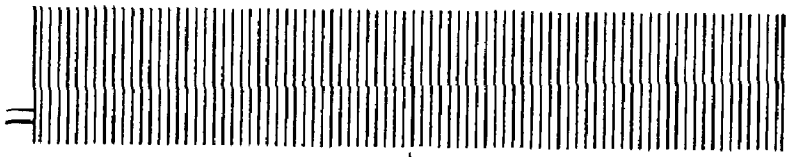
FIG. 16 is a front elevational view of a humidifying liquid cooler heat exchanger utilised in the apparatus in FIG. 1.
Figure 17:
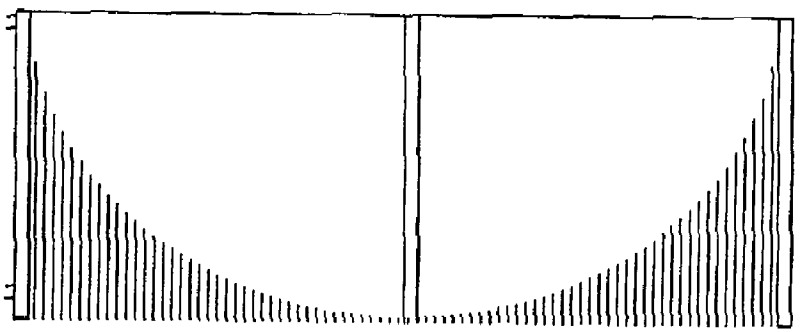
FIG. 17 is a plan view of the cooler shown in FIG. 16.
Figure 18:
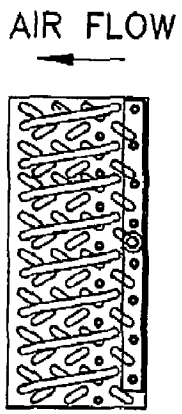
FIG. 18 is an end elevation at one side edge of the cooler shown in FIG. 16.
Figure 19:
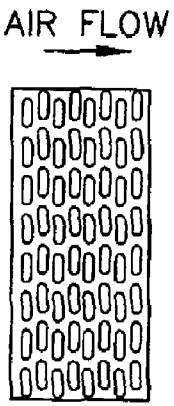
FIG. 19 is an end elevation of the cooler shown in FIG. 18 and, FIG. 20 is an underneath perspective view of a header tank and humidifying liquid distribution means utilised in the apparatus of FIG. 1.

FIGS. 13, 14 and 15 are plan views, front elevational views, and end elevational views, respectively, of the case 5. These figures show that the case 5 has an upper lip 37 which is useful for mounting of the case 5 relative to the chassis 9. An opening 39 is provided at each side of the casing 5 to accommodate the fitting of the respective fans 11.

FIGS. 16, 17, 18 and 19 are views that show the liquid cooler heat exchanger 15. The compressor and other units that form the driving functional components of the liquid cooler have not been shown in order to aid clarity. These components are considered known and may be mounted external of the apparatus 1 at a suitable location. The way in which the liquid cooler heat exchanger 15 is cooled is known per se.

The figures show that the liquid cooler heat exchanger 15 has a series of vertically oriented heat exchanger plates 41 that interconnect with respective cooling pipes 43. Thus, humidifying liquid that is distributed to the top of the liquid cooler heat exchanger 15 passes downwardly through the liquid cooler heat exchanger 15, and there is heat exchange with the plates 41. Thus, the humidifying liquid that discharges from the bottom of the liquid cooler heat exchanger 15 is cooled and passes onto the upper surface of the cell 13.

Figure 20:
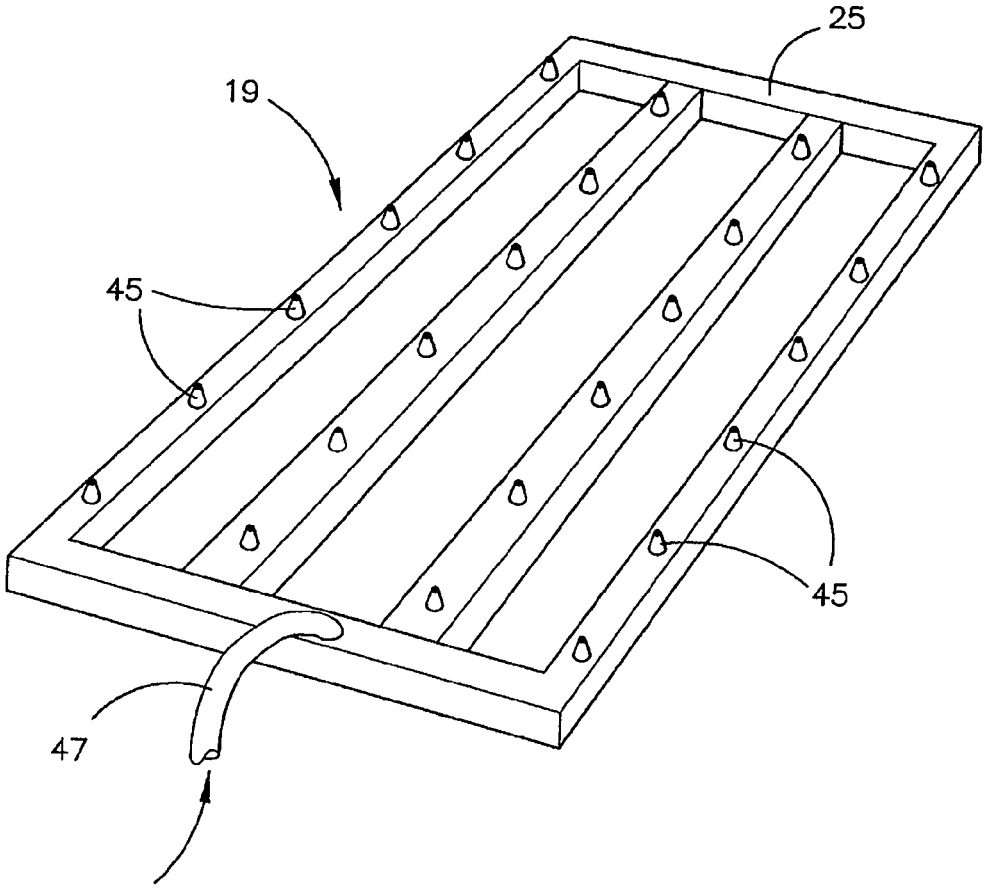

FIG. 20 is an underneath perspective view of the header distribution tank 25 and nozzles thereon which collectively form the humidifying liquid distribution means 19. The nozzles are shown by numeral 45. Typically, the header distribution tank 25 is tubular and connects with an input 47 to receive the humidifying liquid from the pump 23 in the sump 21. Thus, as there is a positive head of pressure within the header distribution tank 25, each of the forty nozzles 45 is able to uniformly and equally discharge the humidifying liquid therefrom in a downward conical spray. The diameter of the cones and the spacing apart of the nozzles 45 is such that an imaginary cone from one nozzle 45 intersects an imaginary cone from an adjacent nozzle at the upper surface of the cell 13.

An air handling heat exchanger humidifying apparatus of the type described above has been found to be particularly useful in cool room stores for the keeping of fresh vegetable produce. Apparatus of this type is suitable for other purposes, and the invention is not to be limited to air handling heat exchanger humidifying apparatus for vegetables. Other examples of use may be when storing fruits. Other uses may be for storing flowers. The particular use of the apparatus is where products need to be maintained in a high humidity atmosphere and optionally with a particular temperature control which can be achieved using the cooling techniques described herein. Further, by applying heat to the heat exchanger 15, the humidifying liquid may be heated and in some environments this may be desirable if the air is to be heated.

Modifications may be made to the invention as would be apparent to persons skilled in the art of producing air handling heat exchanger humidifying apparatus. For example, instead of cooling the humidifying liquid that is distributed from the humidifying liquid distribution means 19 by directly passing it through the heat exchanger 15, it may be possible to remotely cool (or heat) the humidifying liquid and pass it directly into the apparatus 1 for distribution by the distribution means 19, thereby avoiding the need for the heat exchanger 15. In this way, an even more compact height air handling heat exchanger humidifying apparatus may be provided than in the example disclosed. This and any other modification is deemed within the scope of the invention, the nature of which is to be determined from the foregoing description and the appended claims.

The invention claimed is:

1. An air handling heat exchanging humidifying apparatus comprising;

an external outer case and mounted within said case a heat exchanger humidifying cell, said cell having a self supporting sheet like body with a multitude of air openings therethrough that are created by cutting parallel rows of slits into the sheet like body, and then expanding the sheet like body by pulling two opposing edges of the sheet like body that are perpendicular to rows of slits, the sheet like body then being formed to have a corrugated or saw tooth profile with the multitude of air openings being arranged in faces of the corrugated or saw tooth profile, the body defining arm surfaces around the openings on which a humidifying liquid can be deposited, cell mounting means mounting said cell in said case so the body is in a generally horizontally extending self supporting plane, humidifying liquid distribution means in said case above said cell for distributing humidifying liquid so it will be deposited onto the top of the cell and to said surfaces, a humidifying liquid cooler in said case and mounted directly adjacent said cell for cooling the humidifying liquid immediately before being deposited onto said surfaces, an air mover for moving air in a direction upwardly through the openings of the cell where humidifying liquid on said surfaces can be collected by the passage of air, and an air outlet for permitting air and any collected humidifying liquid moved by said air mover to be discharged from said apparatus.

2. The apparatus of claim 1 wherein the cooler has a heat exchanger situated between the humidifying liquid distributing means and an upper surface of said cell so that as humidifying liquid is distributed, said humidifying liquid passes through said heat exchanger and is cooled thereby before being collected on said surfaces.

3. The apparatus of claim 1 wherein the cell is of a mesh like sheet configuration with closely spaced air openings.

4. The apparatus of claim 3, wherein the mesh is an expanded mesh.

5. The apparatus of claim 3, wherein the mesh openings are generally diamond shaped.

6. The apparatus of claim 3, wherein the arm surfaces are flattened surfaces formed by a flattening process after a mesh expansion process.

7. The apparatus of claim 1, wherein there are many corrugations and the profile of each of the corrugations is of a regular saw tooth configuration.

8. The apparatus of claim 1, wherein the cell is made of metal.

9. The apparatus of claim 1, wherein the cell is made from titanium.

* * * * *